US006714103B2

(12) United States Patent
Kundu

(10) Patent No.: US 6,714,103 B2
(45) Date of Patent: Mar. 30, 2004

(54) TEM BAND PASS FILTER HAVING AN EVANESCENT WAVEGUIDE

(75) Inventor: Arun Chandra Kundu, Tokyo (JP)

(73) Assignee: TDK Corporation, Tokyo (JP)

( * ) Notice: Subject to any disclaimer, the term of this patent is extended or adjusted under 35 U.S.C. 154(b) by 95 days.

(21) Appl. No.: 10/005,724

(22) Filed: Nov. 2, 2001

(65) Prior Publication Data

US 2002/0158718 A1 Oct. 31, 2002

(30) Foreign Application Priority Data

Mar. 19, 2001 (JP) ..... 2001-078540
Jun. 22, 2001 (JP) ..... 2001-189080

(51) Int. Cl.[7] ..... H01P 1/20; H01P 1/219
(52) U.S. Cl. ..... 333/210; 333/202
(58) Field of Search ..... 333/210, 202, 333/208, 212

(56) References Cited

U.S. PATENT DOCUMENTS 4,837,535 A 6/1989 Konishi ..... 333/210

FOREIGN PATENT DOCUMENTS

EP 0 855 757 A2 7/1998
EP 1024548 8/2000

OTHER PUBLICATIONS

Hee Yong Hwang, Sang–Won Yun and Ik–Soo Chang, "A Novel $TE_{108}$Rectangular Waveguide Resonator and its Bandpass Filter Applications," Proceedings of the Korean–Japan Microwave Workshop (KJMW–200), pp. 86–89, Sep. 2000.

Yoshiro Konishi, "Novel Dielectric Waveguide Components—Microwave Applications of New Ceramic Materials," Proceedings of the IEEE, vol. 79, pp. 726–740, Jun. 1991.

Arun Chandra Kundu and Kenji Endou, "TEM–Mode Planar Dielectric Waveguide Resonator BPF for W–CDMA," IEEE International Microwave Symposium Digest, vol. 1, pp.191–194, Jun. 2000.

Ikuo Awai and Arun Chandra Kundu, "Distributed Coupling of Dual–Modes in a Circular Resonator and Low–Profile Dielectric Disk Resonator BPF," IEICE Transactions on Electronics. vol. E82–C, No. 2, pp.393–401, Feb. 1999.

Seng–Woo Chen and Kawthar A. Zaki, "A Novel Coupling Method for Dual–Mode Dielectric Resonators and Waveguide Filters," IEEE Transactions on Microwave Theory and Techniques, vol. 38, No. 12, pp. 1885–1893, Dec. 1990.

Amr Abdelmonem et al, "Spurious Free D.L. TE Mode Band Pass Filter", Microwave Symposium Digest, 1994; IEEE MTT–S International San Diego, Ca., USA May 23–27 1994; New York, NY, USA, IEEE May 23, 1994; pp. 735–738.

Hussein Baher et al., "A New Class of Evanescent–Mode Waveguide Filters", Electronics, Circuits, and Systems, 1996; ICECS 1996, Proceedings of the Third IEEE International Conference on Rodos, Greece Oct. 13–16, 1996; New York, NY USA, IEEE, US, Oct. 13, 1996, pp. 335–338.

*Primary Examiner*—Robert J. Pascal
*Assistant Examiner*—Stephen E. Jones
(74) *Attorney, Agent, or Firm*—Brown Raysman Millstein Felder & Steiner LLP

(57) ABSTRACT

A highly compact and easily fabricated band pass filter is disclosed. A band pass filter according to the present invention employs a first half-wave (λ/2) resonator having a first open end on which an input terminal is formed and a second open end opposite to the first open end, a second half-wave (λ/2) resonator having a third open end on which an output terminal is formed and a fourth open end opposite to the third open end, and an evanescent waveguide interposed between the second open end of the first resonator and the fourth open end of the second resonator. The first half-wave (λ/2) resonator, the second half-wave (λ/2) resonator, and the evanescent waveguide being single-unit. An air gap does not have to be formed by mounting components on a printed circuit board. Therefore, the overall size of the band pass filter can be miniaturized and fabrication of the band pass filter is simplified.

5 Claims, 15 Drawing Sheets

TEM BAND PASS FILTER HAVING AN EVANESCENT WAVEGUIDE

BACKGROUND OF THE INVENTION

The present invention relates to a band pass filter, and particularly, to a highly compact and easily fabricated band pass filter.

DESCRIPTION OF THE PRIOR ART

In recent years, marked advances in miniaturization of communication terminals, typically mobile phones, has been achieved thanks to miniaturization of the various components incorporated therein. One of the most important components incorporated in a communication terminal is a band pass filter.

As shown in "A Novel $TE_{10\delta}$ Rectangular Waveguide Resonator and Its Bandpass Filter Applications (Proceedings of the Korea-Japan Microwave Workshop 2000, September 2000)", p. 88, FIG. 8, such a band pass filter is known wherein a plurality of TE mode half-wave (λ/2) dielectric resonators are disposed on a printed circuit board at predetermined spacing. In the band pass filter described in this paper, the distances between the resonators (air gaps) work as so-called "evanescent waveguides" to couple the adjacent resonators at a predetermined coupling constant.

As a need continues to be felt for still further miniaturization of the various communication terminals, further miniaturization of the band pass filter incorporated therein is also required.

In the band pass filter described above, however, the resonators must be mounted on the printed circuit board because they are coupled by the air gaps. The overall size of the band pass filter tends to be large because it is constituted of a plurality of independent components.

Further, in the band pass filter described above, the air gaps must be exactly adjusted to obtain desired characteristics. Even slight errors in the adjustment of the air gaps change the characteristics of the band pass filter markedly. Therefore, this makes the band pass filter described above very difficult to fabricate. The cost of the band pass filter is therefore high.

Thus, a compact and easily fabricated band pass filter is desired.

SUMMARY OF THE INVENTION

It is therefore an object of the present invention to provide a compact and easily fabricated band pass filter.

The above and other objects of the present invention can be accomplished by a band pass filter comprising: a first half-wave (λ/2) resonator having a first open end on which an input terminal is formed and a second open end opposite to the first open end, a second half-wave (λ/2) resonator having a third open end on which an output terminal is formed and a fourth open end opposite to the third open end, and an evanescent waveguide interposed between the second open end of the first resonator and the fourth open end of the second resonator, the first half-wave (λ/2) resonator, the second half-wave (λ/2) resonator, and the evanescent waveguide being a single unit.

According to this aspect of the present invention, because the first half-wave (λ/2) resonator, the second half-wave (λ/2) resonator, and the evanescent waveguide are a single unit, they do not have to be mounted on a printed circuit board to form an air gap. Therefore, the overall size of the band pass filter can be reduced and fabrication of the band pass filter is simplified.

In a preferred aspect of the present invention, the first half-wave (λ/2) resonator, the second half-wave (λ/2) resonator, and the evanescent waveguide are made of a single dielectric unit.

In a further preferred aspect of the present invention, an overall dimension of the band pass filter is a substantially rectangular prismatic shape.

In a further preferred aspect of the present invention, a passing band of the band pass filter is not less than 5 GHz.

The above and other objects of the present invention can be also accomplished by a band pass filter comprising:

- first and second dielectric blocks each of which has a top surface, a bottom surface, first and second side surfaces opposite to each other, and third and fourth side surfaces opposite to each other;
- a third dielectric block in contact with the first side surface of the first dielectric block and the first side surface of the second dielectric block;
- metal plates formed on the top surfaces, the bottom surfaces, the third side surfaces, and the fourth side surfaces of the first and second dielectric blocks;
- a first electrode formed on the second side surface of the first dielectric block; and
- a second electrode formed on the second side surface of the second dielectric block.

Also according to this aspect of the present invention, an air gap does not have to be formed by mounting components on a printed circuit board. Therefore, the overall size of the band pass filter can be miniaturized and fabrication of the band pass filter is simplified.

In a preferred aspect of the present invention, the first dielectric block and the second dielectric block have the same dimensions.

In a further preferred aspect of the present invention, the third dielectric block has a first side surface in contact with the first side surface of the first dielectric block, a second side surface in contact with the first side surface of the second dielectric block, a third side surface parallel to the third side surface of the first dielectric block, a fourth side surface parallel to the fourth side surface of the first dielectric block, a top surface parallel to the top surface of the first dielectric block, and a bottom surface parallel to the bottom surface of the first dielectric block on which a metal plate is formed.

In a further preferred aspect of the present invention, the bottom surfaces of the first to third dielectric blocks are coplanar.

In a further preferred aspect of the present invention, the top surfaces of the first to third dielectric blocks are coplanar.

In a further preferred aspect of the present invention, the members of at least one pair of surfaces among a first pair consisting of the top surfaces of the first and third dielectric blocks, a second pair consisting of the third surfaces of the first and third dielectric blocks, and a third pair consisting of the fourth surfaces of the first and third dielectric blocks fall in different planes.

In a further preferred aspect of the present invention, the first dielectric block and the metal plates formed on the top surface, bottom surface, second side surface, and third side surface thereof constitute a first half-wave (λ/2) dielectric resonator, the second dielectric block and the metal plates formed on the top surface, bottom surface, second side surface, and third side surface thereof constitute a second half-wave (λ/2) dielectric resonator, and the third dielectric block constitutes an evanescent waveguide.

The above and other objects of the present invention can be also accomplished by a band pass filter comprising: a plurality of half-wave (λ/2) dielectric resonators and at least one evanescent waveguide interposed between adjacent half-wave (λ/2) dielectric resonators, the half-wave (λ/2) dielectric resonators and the evanescent waveguide being made of a single dielectric unit.

Also, according to this aspect of the present invention, an air gap does not have to be formed by mounting components on a printed circuit board. Therefore, the overall size of the band pass filter can be miniaturized and fabrication of the band pass filter is simplified.

In a preferred aspect of the present invention, an overall dimension of the band pass filter is a substantially rectangular prismatic shape.

In another preferred aspect of the present invention, at least one slit is formed in the dielectric block at a portion thereof acting as the evanescent waveguide.

The above and other objects of the present invention can be also accomplished by a band pass filter comprising: a dielectric block of substantially rectangular prismatic shape constituted of a first portion lying between a first cross-section of the dielectric block and a second cross-section of the dielectric block substantially parallel to first cross-section and second and third portions divided by the first portion and metal plates formed on the surfaces of the dielectric block, thereby enabling the first portion of the dielectric block and the metal plates formed thereon to act as an evanescent waveguide, the second portion of the dielectric block and the metal plates formed thereon to act as a first resonator, and the third portion of the dielectric block and the metal plates formed thereon to act as a second resonator, the metal plates being formed on, among the surfaces of the second and third portions of the dielectric block, each surface which is substantially perpendicular to the cross-sections.

According to this aspect of the present invention, since the band pass filter is constituted of the dielectric block of rectangular prismatic shape, the mechanical strength is extremely high and low in cost.

In a preferred aspect of the present invention, the metal plates further include a first exciting electrode formed on, among the surfaces of the second portion of the dielectric block, a surface which is substantially parallel to the cross-sections and a second exciting electrode formed on, among the surfaces of the third portion of the dielectric block, a surface which is substantially parallel to the cross-sections.

BRIEF DESCRIPTION OF THE DRAWINGS

FIG. 5(*b*) is a schematic diagram showing a parallel metal plate waveguide mode electric field at the reference plane of FIG. 5(*a*).

DESCRIPTION OF THE PREFERRED EMBODIMENTS

Preferred embodiments of the present invention will now be explained with reference to the drawings.

Figure 1:
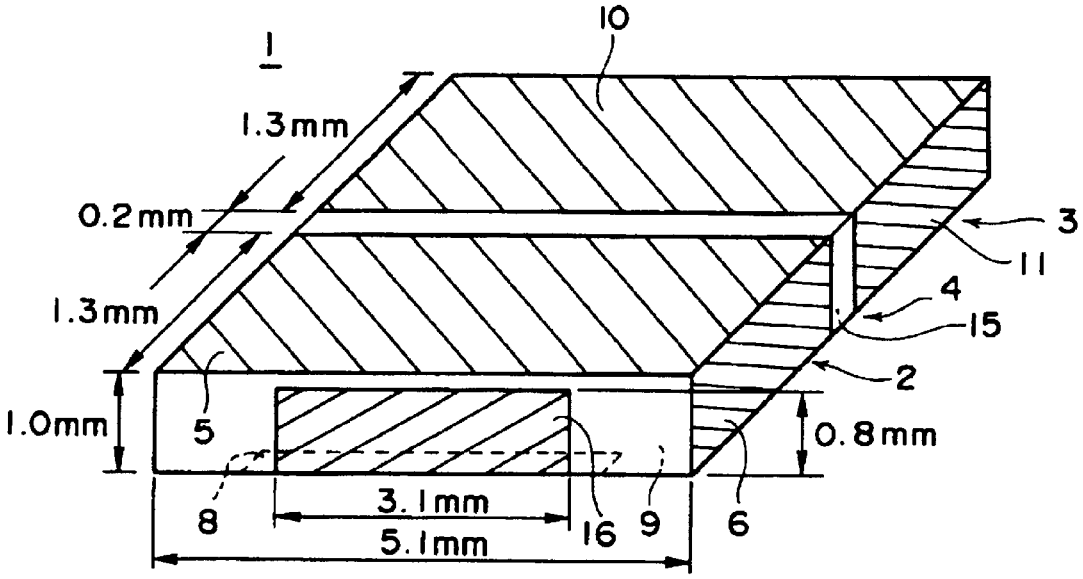
FIG. 1 is a schematic perspective view from one side showing a band pass filter 1 that is a preferred embodiment of the present invention.
Figure 2:
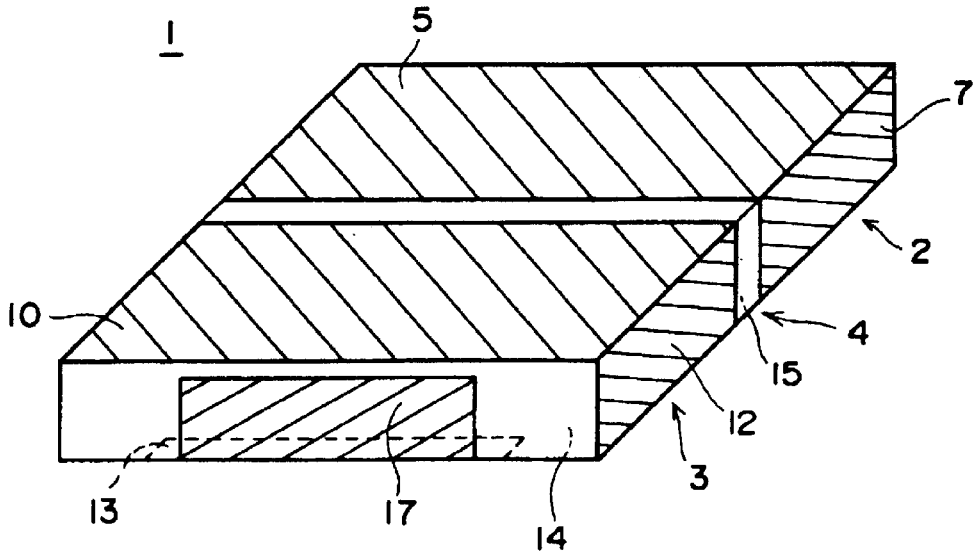
FIG. 2 is a schematic perspective view from the opposite side showing the band pass filter 1 of FIG. 1.
Figure 3:
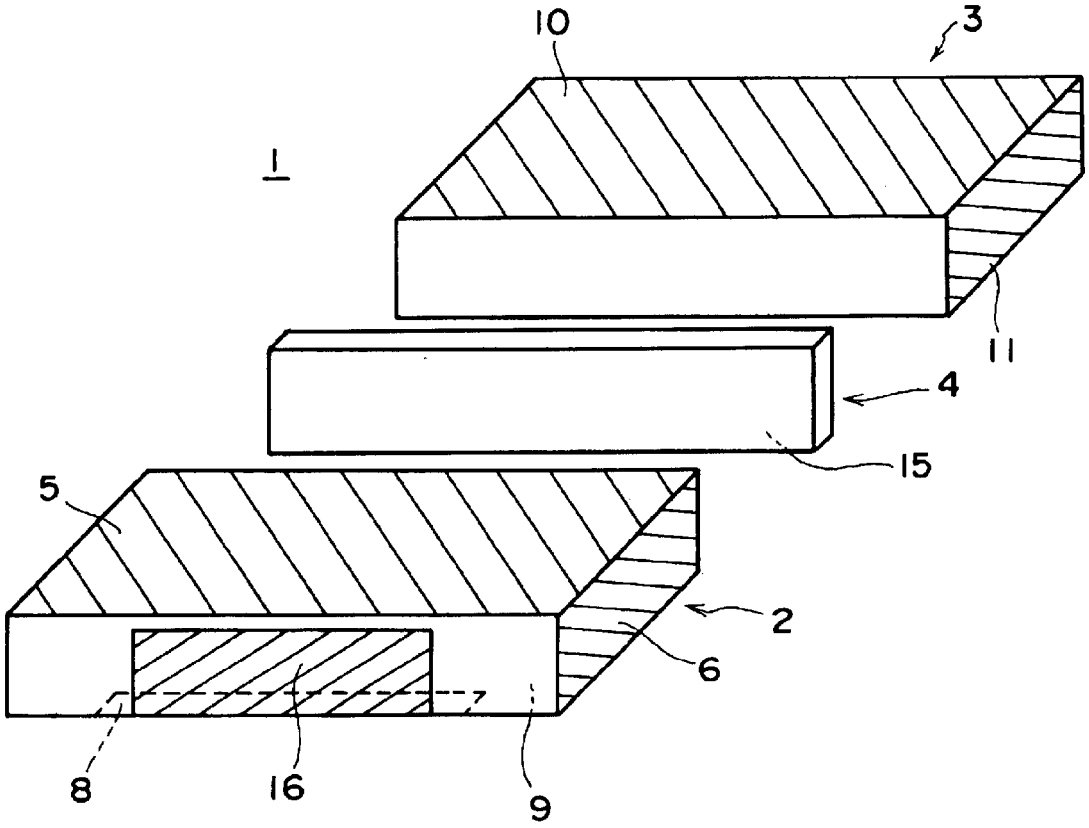
FIG. 3 is an exploded schematic perspective view showing the band pass filter 1 of FIG. 1.

As shown in FIGS. 1 to 3, a band pass filter 1 that is a preferred embodiment of the present invention is constituted of a first resonator 2, a second resonator 3, and an evanescent waveguide 4 interposed between the first and second resonators 2 and 3.

The first resonator 2 and the second resonator 3 are symmetrical. Each is composed of a dielectric block whose length, width, and thickness are 1.3 mm, 5.1 mm, and 1.0 mm. These dielectric blocks are made of dielectric material whose dielectric constant $\in r=37$. The evanescent waveguide 4 is composed of a dielectric block whose length, width, and thickness are 0.2 mm, 5.1 mm, and 1.0 mm. It is made of the same dielectric material as the dielectric blocks composing the first and second resonators 2 and 3. Thus, the band pass filter 1 measures 2.8 mm, 5.1 mm, and 1.0 mm in length, width, and thickness.

The first resonator 2, the second resonator 3, and the evanescent waveguide 4 are combined such that their bottom surfaces are coplanar. It is worth noting that this does not mean that they are physically different components. That is, the band pass filter 1 of this preferred embodiment is constituted of the single dielectric unit of substantially rectangular prismatic shape.

In this specification, the surfaces opposite to the associated bottom surfaces of the dielectric blocks composing the first resonator 2, the second resonator 3, and the evanescent waveguide 4 are each defined as a "top surface." Among the surfaces of the dielectric blocks composing the first and the second resonators 2 and 3, each surface in contact with the evanescent waveguide 4 is defined as a "first side surface." Among the surfaces of the dielectric blocks composing the first and the second resonators 2 and 3, each surface opposite to the first side surface is defined as a "second side surface." The remaining surfaces of the dielectric blocks composing the first and second resonators 2 and 3 are defined as a "third side surface" and a "fourth side surface" with respect to each block. Among the surfaces of the dielectric block composing the evanescent waveguide 4, the surface in contact with the first side surface of the first resonator 2 is defined as a "first side surface." Among the surfaces of the dielectric block composing the evanescent waveguide 4, the surface in contact with the first side surface of the second resonator 3 is defined as a "second side surface." The remaining surfaces of the dielectric block composing the evanescent waveguide 4 are defined as a "third side surface" and a "fourth side surface." Therefore, "length," "width," and "thickness" of the first resonator 2, the second resonator 3, and the evanescent waveguide 4 are defined by the distance between the first and second side surfaces, the distance between the third and fourth side surfaces, and the distance between the top and bottom surfaces, respectively. The third side surfaces of the first resonator 2, second resonator 3, and evanescent waveguide 4 are coplanar, and the fourth side surfaces of the first resonator 2, second resonator 3, and evanescent waveguide 4 are also coplanar.

As shown in FIGS. 1 to 3, metal plates 5, 6, and 7 are formed on the entire top surface, the entire third side surface, and entire fourth side surface of the first resonator 2 and a metal plate 9 is formed on the bottom surface of the first resonator 2 except at a clearance portion 8. These metal plates 5, 6, 7, and 9 are short-circuited with one another. Similarly, metal plates 10, 11, and 12 are formed on the entire top surface, the entire third side surface, and entire fourth side surface of the second resonator 3 and a metal plate 14 is formed on the bottom surface of the second resonator 3 except at a clearance portion 13. These metal plates 10, 11 12, and 14 are short-circuited with one another. A metal plate 15 is formed on the entire bottom surface of the evanescent waveguide 4. These metal plates 5, 6, 7, 9, 10, 11, 12, 14, and 15 are thus short-circuited with one another and grounded.

As shown in FIGS. 1 and 3, an exciting electrode 16 whose height and width are 0.8 mm and 3.1 mm is formed on the second side surface of the first resonator 2 where the clearance portion 8 prevents the exciting electrode 16 from being in contact with the metal plate 9 formed on the bottom surface. Similarly, as shown in FIG. 2, an exciting electrode 17 whose height and width are 0.8 mm and 3.1 mm is formed on the second side surface of the second resonator 3 where the clearance portion 13 prevents the exciting electrode 17 from being in contact with the metal plate 14 formed on the bottom surface. One of the exciting electrodes 16 and 17 is used as an input electrode, and the other is used as an output electrode.

The metal plates 5, 6, 7, 9, 10, 11, 12, 14, and 15 and the exciting electrodes 16 and 17 are made of silver. However, the present invention is not limited to using silver and other kinds of metal can be used instead.

No electrode is formed on the remaining surfaces of the first resonator 2, second resonator 3, and evanescent waveguide 4, which therefore constitute open ends.

Each of the first resonator 2 and the second resonator 3 having the above described structure acts as a half-wave ($\lambda/2$) dielectric resonator. The evanescent waveguide 4 having the above-described structure acts as an E-mode waveguide.

The characteristics of the half-wave ($\lambda/2$) dielectric resonators constituted by the first resonator 2 and the second resonator 3 will now be explained.

Figure 4:
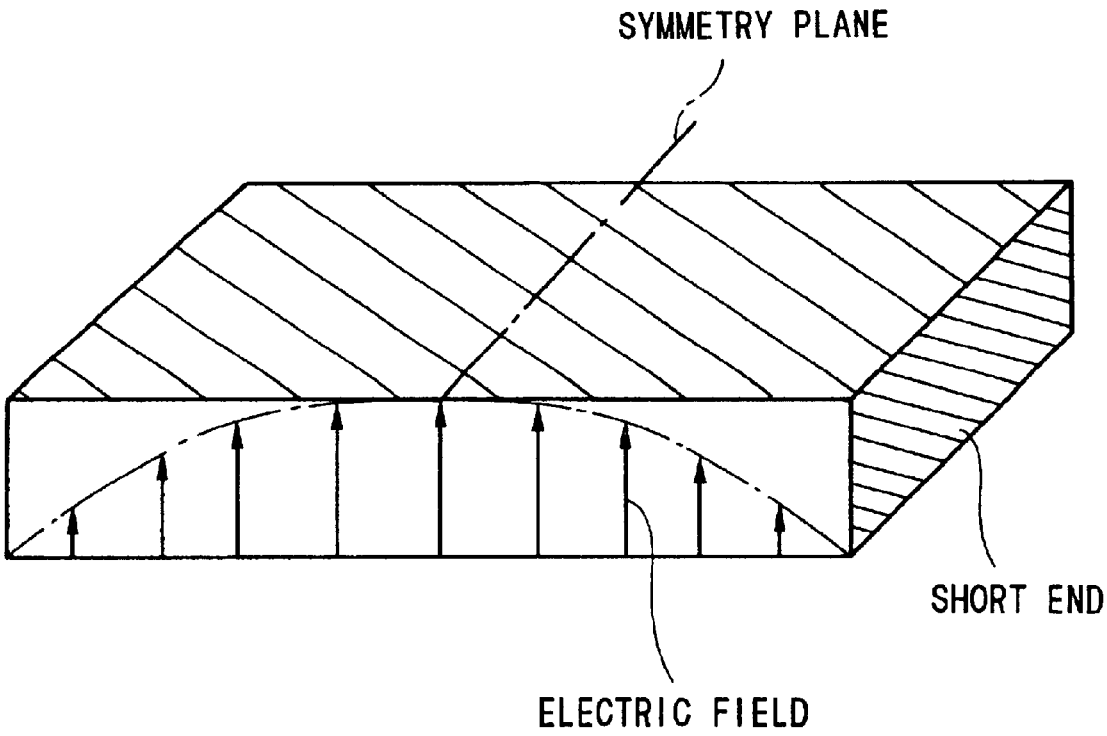
FIG. 4 is a schematic diagram showing the strength of an electric field generated by a half-wave (λ/2) dielectric resonator.

FIG. 4 is a schematic diagram showing the strength of an electric field generated by the half-wave ($\lambda/2$) dielectric resonator.

As shown in FIG. 4, in this type of the half-wave ($\lambda/2$) dielectric resonator, the electric field is minimum at the side surfaces (the third and fourth side surfaces), on which the metal plates short-circuiting the metal plates formed on the top and bottom surfaces are formed, and the electric field is maximum at a symmetry plane, which is not exposed to the air. Therefore, in this type of the half-wave ($\lambda/2$) dielectric resonator, the radiation loss is much smaller than that of a quarter-wave ($\lambda/4$) dielectric resonator. The overall size of the half-wave ($\lambda/2$) dielectric resonator is almost double that of a quarter-wave ($\lambda/4$) dielectric resonator having the same characteristics. However, in this type of half-wave ($\lambda/2$) dielectric resonator, the resonant frequency is inversely proportional to the width of the dielectric block. Therefore, in the case where the desired resonant frequency is relatively high, such as 5.25 GHz, the overall size of the half-wave ($\lambda/2$) dielectric resonator should be small.

Figure 5:
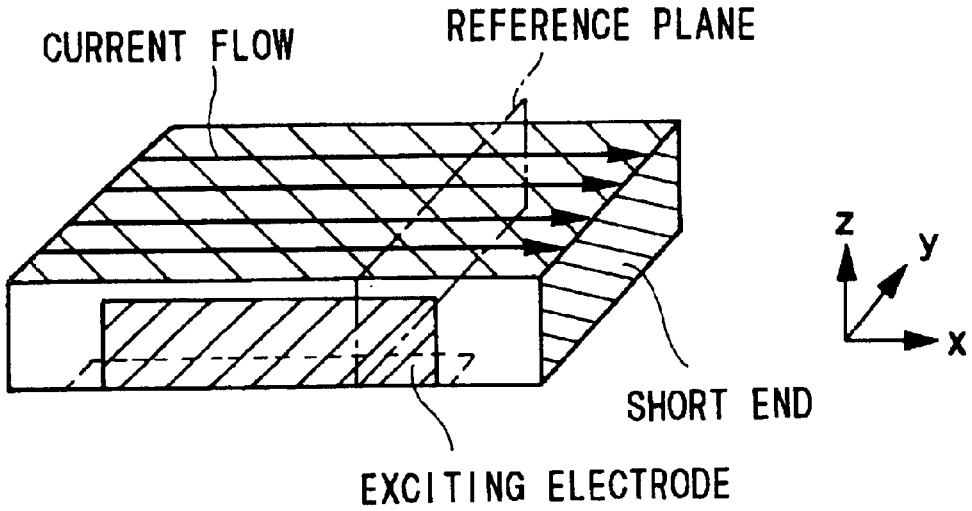
FIG. 5(*a*) is a schematic diagram showing current flow in a half-wave (λ/2) dielectric resonator.
Figure 5:
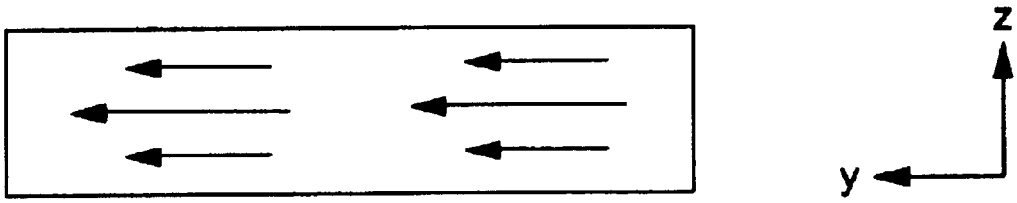

As shown in FIG. 5(*a*), in this type of the half-wave ($\lambda/2$) dielectric resonator, current flows along the x-axis, which is the direction of mode propagation. The location of the exciting electrode is not along the direction of the mode propagation. For this type of excitation, the TE-mode electric field of the parallel metal waveguide mode is also excited in addition to the expected TEM-mode.

FIG. 5(*b*) is a schematic diagram showing the TE-mode electric field of the parallel metal plate waveguide mode at the reference plane of FIG. 5(*a*).

In a band pass filter constituted of two TEM-mode half-wave ($\lambda/2$) dielectric resonators, the TE-mode electric fields of the parallel metal waveguide mode are opposite in direction and capacitive coupling occurs between them which is the direct coupling between I/O ports.

Figure 6:
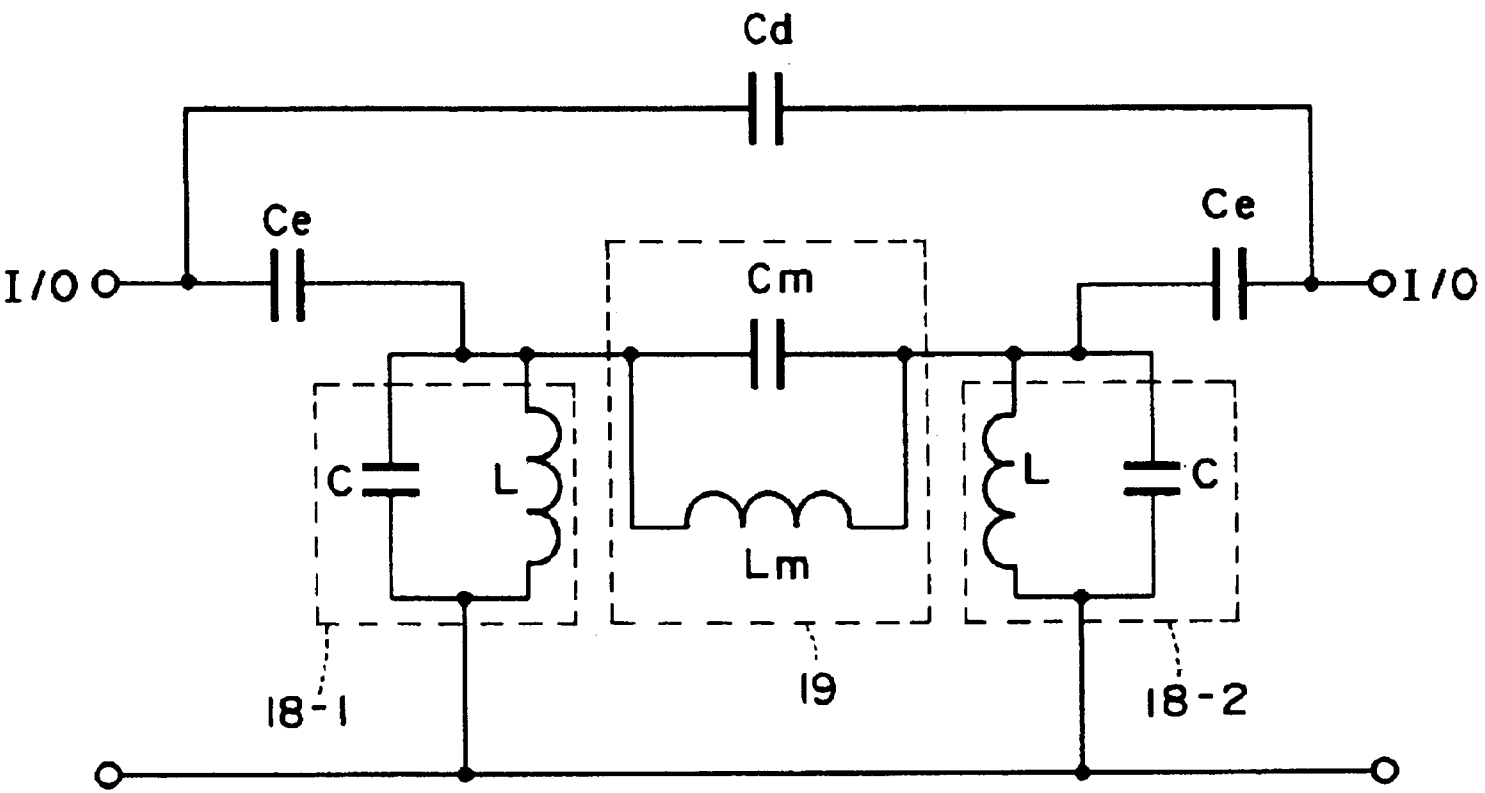
FIG. 6 is an equivalent circuit diagram of the band pass filter 1 shown in FIGS. 1 to 3.

FIG. 6 is an equivalent circuit diagram of the band pass filter 1 shown in FIGS. 1 to 3.

In this figure, the first resonator 2 and the second resonator 3 are represented by two L-C parallel circuits 18-1 and 18-2, respectively. The evanescent waveguide 4 is represented by an L-C parallel circuit 19 consisting of an inductor Lm and a capacitor Cm. The L-C parallel circuit 19 gives an internal coupling between the first resonator 2 and the second resonator 3. The exciting electrodes 16 and 17 are represented by two capacitances Ce. The capacitance Cd represents the direct coupling capacitance between the exciting electrodes 16 and 17.

Figure 7:
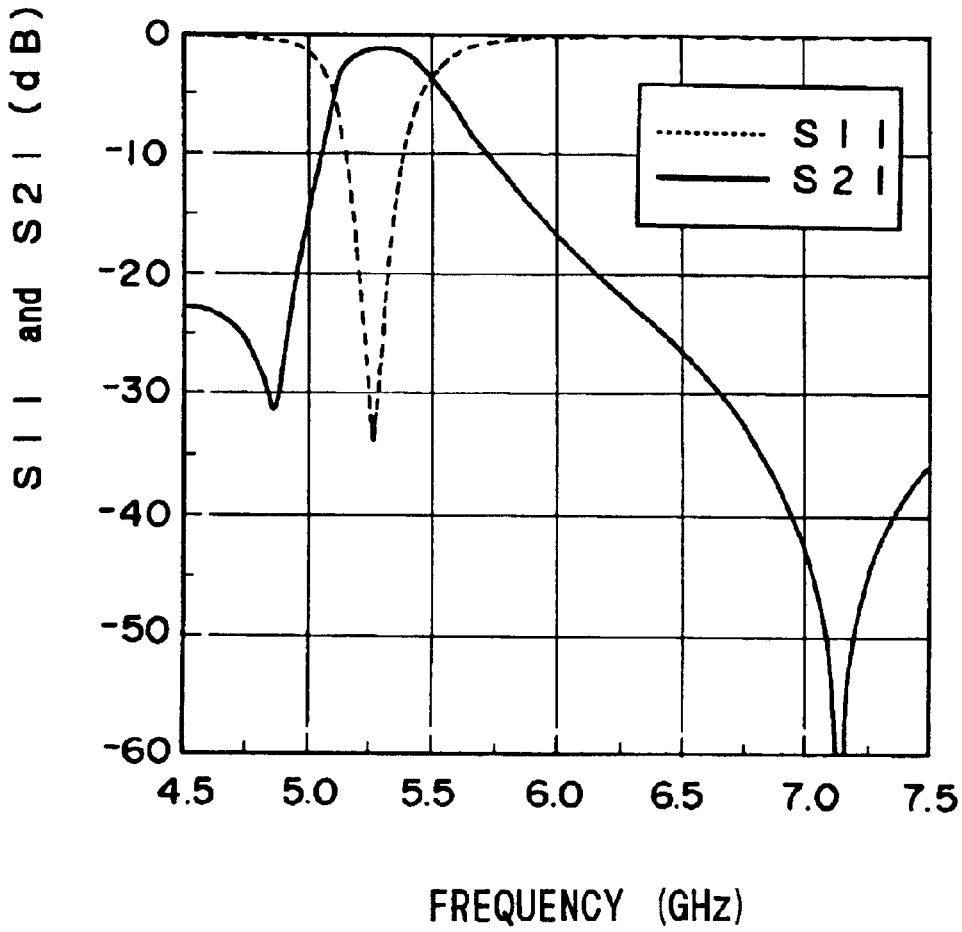
FIG. 7 is a graph showing the frequency characteristic curve of the band pass filter 1 shown in FIGS. 1 to 3.

FIG. 7 is a graph showing the frequency characteristic curve of the band pass filter 1 shown in FIGS. 1 to 3.

In this Figure, S11 represents the reflection coefficient, and S21 represents the transmission coefficient. As shown in FIG. 7, the resonant frequency of the band pass filter 1 is approximately 5.25 GHz and its 3-dB bandwidth is approximately 410 MHz. Further, attenuation poles appear at approximately 4.8 GHz and 7.2 GHz because the dominant coupling between the two resonators by the evanescent waveguide 4 is inductive. No attenuation pole appears in the case where the dominant coupling between the two resonators by the evanescent waveguide 4 is capacitive. As is apparent from FIG. 7, the lower edge of the passing band of the frequency characteristics is sharpened compared with the higher edge of the passing band.

Figure 8:
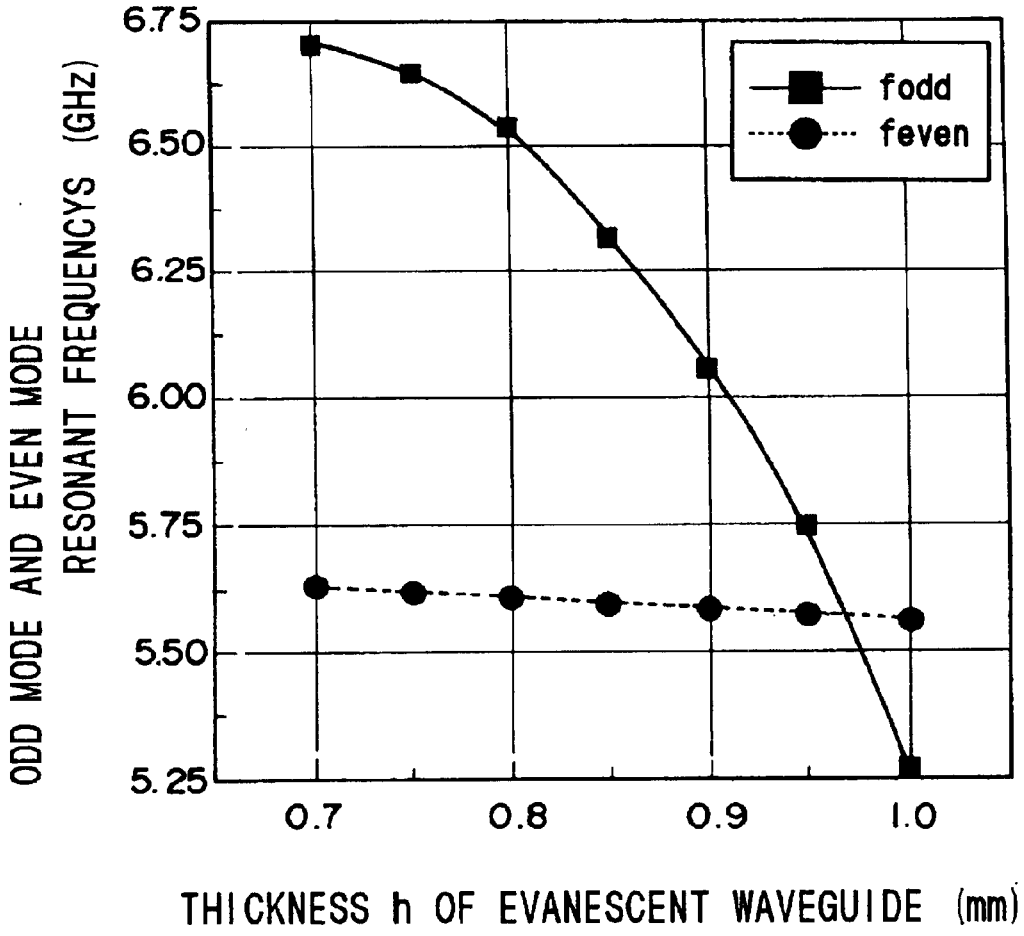
FIG. 8 is a graph showing the relationship between the thickness h of an evanescent waveguide 4 and an odd mode resonant frequency $f_{odd}$ and an even mode resonant frequency $f_{even}$.

FIG. 8 is a graph showing the relationship between the thickness h of the evanescent waveguide 4 and the odd mode resonant frequency $f_{odd}$ and even mode resonant frequency $f_{even}$.

As shown in FIG. 8, although the even mode resonant frequency $f_{even}$ has very little dependence upon the thickness h of the evanescent waveguide 4, the odd mode resonant frequency $f_{odd}$ markedly decreases with increasing thickness h. In the region where the thickness h of the evanescent waveguide 4 is smaller than 0.965 mm (first region), the odd mode resonant frequency $f_{odd}$ is higher than the even mode resonant frequency $f_{even}$. In the region where the thickness h of the evanescent waveguide 4 is higher than 0.965 mm (second region), the even mode resonant frequency $f_{even}$ is higher than the odd mode resonant frequency $f_{odd}$. In the region where the thickness h of the evanescent waveguide 4 is 0.965 mm, the odd mode resonant frequency $f_{odd}$ and the even mode resonant frequency $f_{even}$ are equal to each other. This implies that the dominant coupling between the two resonators by the evanescent waveguide 4 is capacitive in the first region, and the dominant coupling between the two resonators by the evanescent waveguide 4 is inductive in the second region.

The coupling constant k can be represented by the following equation.

$$k = \frac{f_{even}^2 - f_{odd}^2}{f_{even}^2 + f_{odd}^2} \quad (1)$$

The relationship between the thickness h of the evanescent waveguide 4 and the coupling constant k can be obtained by referring to the equation (1).

Figure 9:
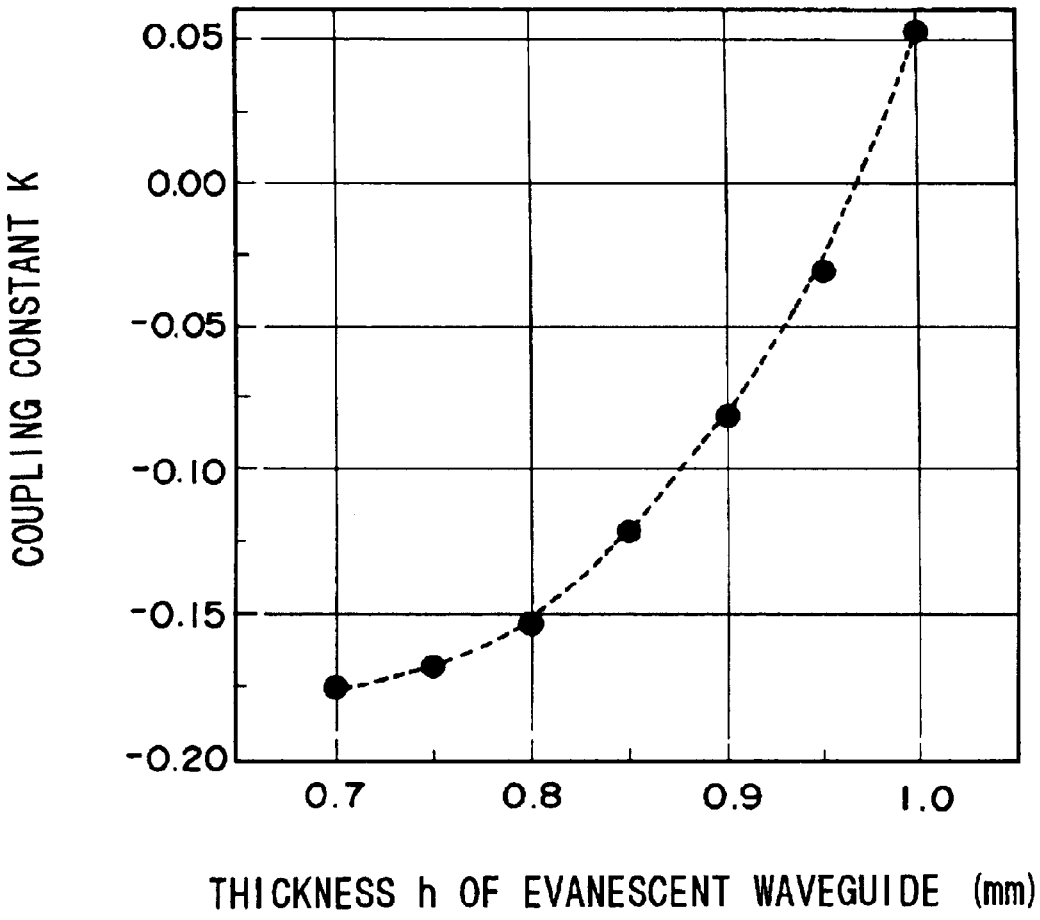
FIG. 9 is a graph showing the relationship between the thickness h of an evanescent waveguide 4 and a coupling constant k.

FIG. 9 is a graph showing the relationship between the thickness h of the evanescent waveguide 4 and the coupling constant k obtained from the equation (1).

The coupling constant k can be considered as a combination of the capacitive coupling constant $k_c$ and the inductive coupling constant $k_i$.

As shown in FIG. 9, the coupling constant $k_{total}$ exponentially increases with increasing thickness h of the evanescent waveguide 4 and becomes zero at a thickness h of 0.965 mm. This means that the capacitive coupling constant $k_c$ and the inductive coupling constant $k_i$ are equal to each other when the thickness h of the evanescent waveguide 4 is 0.965 mm. In the region where the thickness h of the evanescent waveguide 4 is smaller than 0.965 mm (first region), the capacitive coupling constant $k_c$ becomes greater than the inductive coupling constant $k_i$. In the region where the thickness h of the evanescent waveguide 4 is greater than 0.965 mm (second region), the capacitive coupling constant $k_c$ becomes smaller than the inductive coupling constant $k_i$.

As is apparent from FIG. 9, in the case where the thickness h of the evanescent waveguide 4 is set to 1.0 mm as in the band pass filter 1 according to this embodiment, the dominant coupling of the first resonator 2 and the second resonator 3 becomes inductive, and k is approximately 0.055. In this case, the external quality factor becomes approximately 17.6.

Because, as described above, the band pass filter 1 according to this embodiment is constituted of the first resonator 2, the second resonator 3, and the evanescent waveguide 4 as a single unit, an air gap does not have to be formed by mounting components on a printed circuit board. Therefore, the overall size of the band pass filter 1 can be reduced and fabrication of the band pass filter 1 is simplified.

Further, according to the band pass filter 1, owing to the fact that half-wave (λ/2) dielectric resonators are used for the first resonator 2 and the second resonator 3, the radiation loss occurring at the open ends is very small compared with the case of using quarter-wave (λ/4) dielectric resonators. The overall size of a half-wave (λ/2) dielectric resonator is almost double that of a quarter-wave (λ/4) dielectric resonator. However, in the TEM-mode dielectric resonator, the radiation loss is proportional to the square of the resonant frequency, whereas the size of the resonator is inversely proportional to the resonant frequency. Therefore, in the case where the desired resonant frequency is relatively high, such as over 5 GHz, the band pass filter 1 of this embodiment is particularly effective.

According to the band pass filter 1, the dominant coupling between the first resonator 2 and the second resonator 3 becomes inductive by setting the thickness h of the evanescent waveguide 4 being 1.0 mm (>0.965 mm). However, capacitive dominant coupling between the first resonator 2 and the second resonator 3 can be obtained by setting the thickness h of the evanescent waveguide 4 being smaller than 0.965 mm. Next, another band pass filter whose dominant coupling between the first resonator 2 and the second resonator 3 is inductive by setting the thickness h of the evanescent waveguide 4 being smaller than 0.965 mm will be explained.

Figure 10:
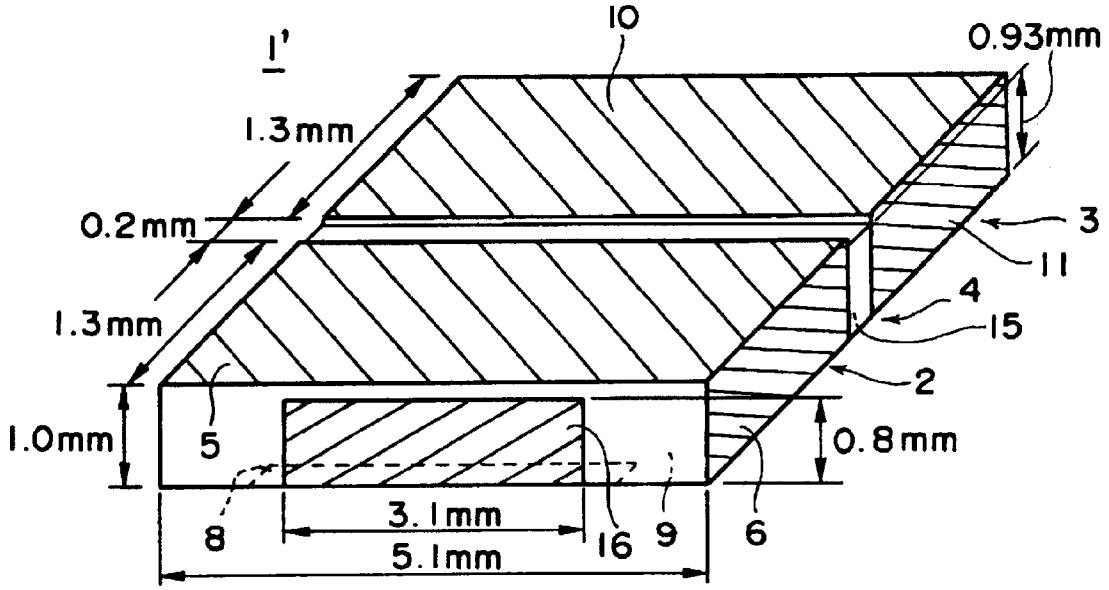
FIG. 10 is a schematic perspective view from one side showing a band pass filter 1' in which the thickness h of the evanescent waveguide 4 is set to smaller than 0.965 mm.
Figure 11:
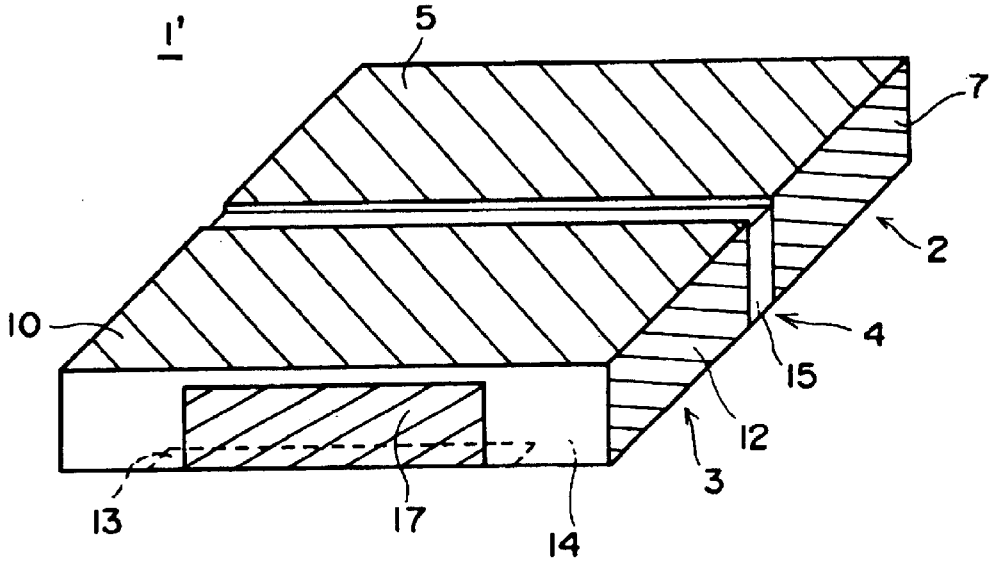
FIG. 11 is a schematic perspective view from the opposite side showing the band pass filter 1' of FIG. 10.

FIG. 10 is a schematic perspective view from one side showing a band pass filter 1' in which the thickness h of the evanescent waveguide 4 is set to smaller than 0.965 mm. FIG. 11 is a schematic perspective view from the opposite side showing the band pass filter 1' of FIG. 10.

As shown in FIGS. 10 and 11, the band pass filter 1' has the same structure and the same dimension as the band pass filter 1 except that the thickness h of the evanescent waveguide 4 is set to 0.93 mm. Therefore, a dielectric unit of such a shape can be fabricated by forming a slit on a single dielectric unit at a portion corresponding to the top surface of the evanescent waveguide 4. As is apparent from FIG. 9, in the case where the thickness h of the evanescent waveguide 4 is set to 0.93 mm as in the band pass filter 1', the dominant coupling of the first resonator 2 and the second resonator 3 becomes capacitive, and k is approximately −0.055.

Figure 12:
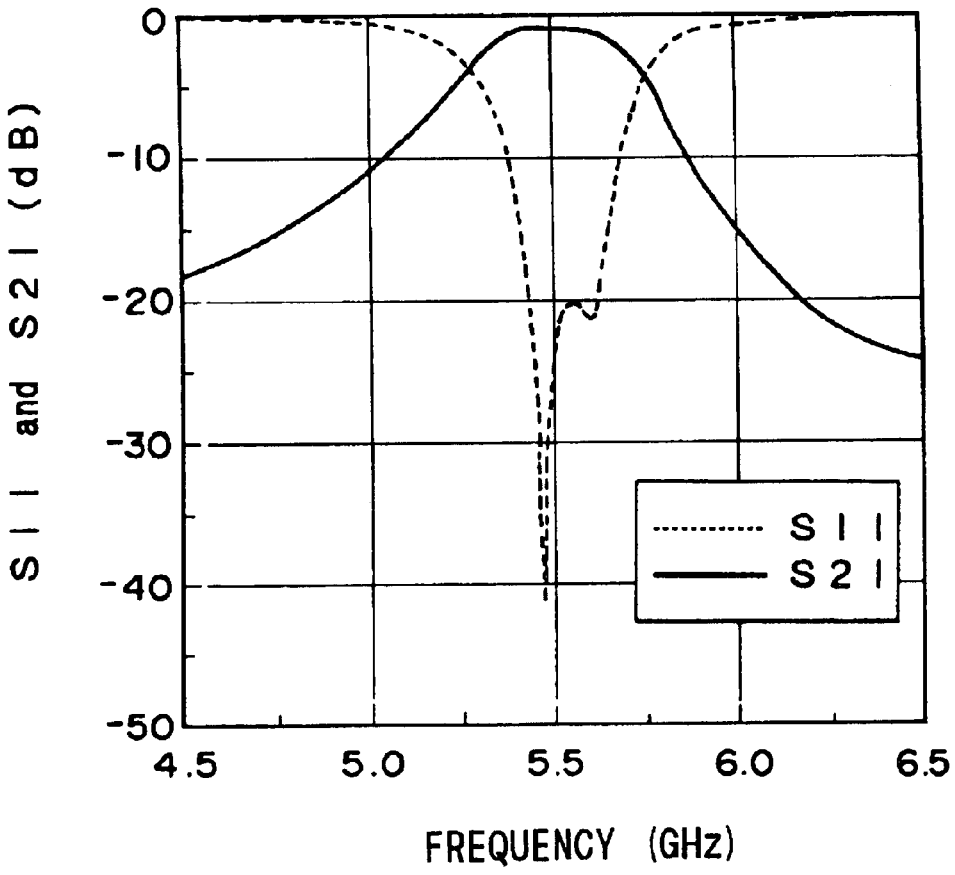
FIG. 12 is a graph showing the frequency characteristic curve of the band pass filter 1' shown in FIGS. 10 and 11.

FIG. 12 is a graph showing the frequency characteristic curve of the band pass filter 1' shown in FIGS. 10 and 11.

In this Figure, S11 represents the reflection coefficient, and S21 represents the transmission coefficient. As shown in FIG. 12, the resonant frequency of the band pass filter 1' is approximately 5.5 GHz and its 3-dB bandwidth is approximately 410 MHz. No attenuation poles appear in contrast to the band pass filter 1. This is because that the dominant coupling between the two resonators by the evanescent waveguide 4 is capacitive. As is apparent from FIG. 12, the higher edge of the passing band of the frequency characteristics is sharpened compared with the lower edge of the passing band.

As described above, according to the band pass filter of this embodiment, the desired coupling constant k can be obtained by controlling the thickness h of the evanescent waveguide 4 so that the desired frequency characteristic can be obtained.

It is worth noting that the coupling constant k between the first resonator 2 and the second resonator 3 can be controlled based on not only the thickness h of the evanescent waveguide 4 but also the width of the evanescent waveguide 4. Another preferred embodiment where the coupling constant k is controlled based on the width of the evanescent waveguide will be explained.

Figure 13:
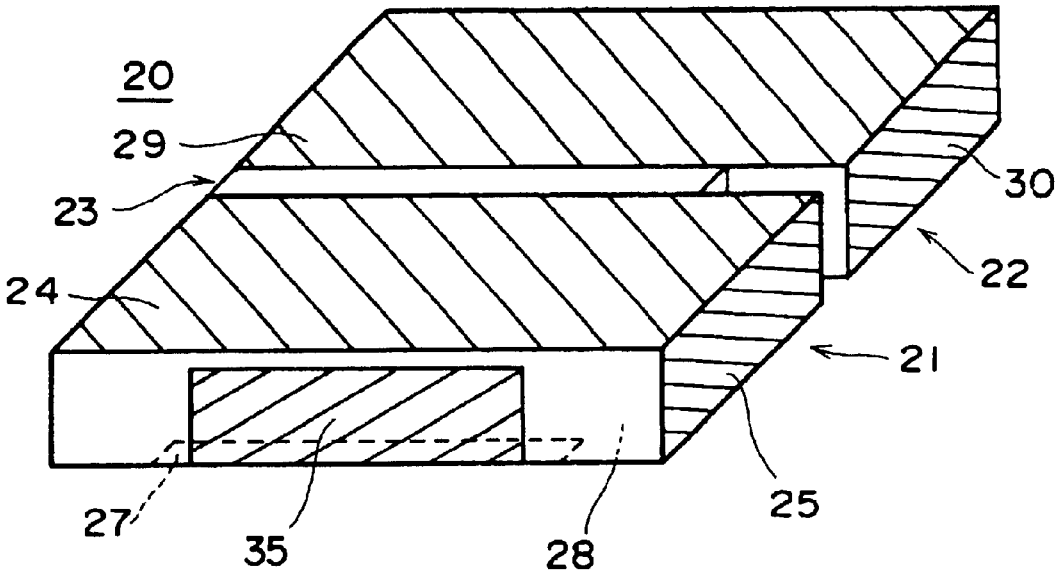
FIG. 13 is a schematic perspective view from one side showing a band pass filter 20 that is another preferred embodiment of the present invention.
Figure 14:
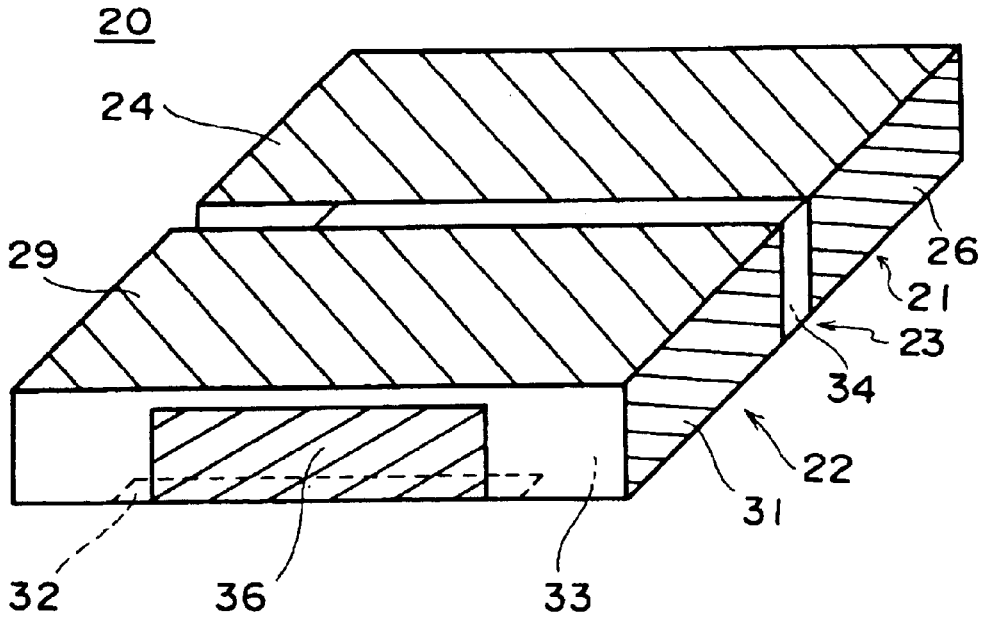
FIG. 14 is a schematic perspective view from the opposite side showing the band pass filter 20 of FIG. 13.

FIG. 13 is a schematic perspective view from one side showing a band pass filter 20 that is another preferred embodiment of the present invention. FIG. 14 is a schematic perspective view from the opposite side showing the band pass filter 20 of FIG. 13.

As shown in FIGS. 13 and 14, the band pass filter 20 that is another preferred embodiment of the present invention is constituted of a first resonator 21, a second resonator 22, and an evanescent waveguide 23 interposed between the first and second resonators 21 and 22. The top surfaces, bottom surfaces, first side surfaces, second side surfaces, third side surfaces, and fourth side surfaces of the dielectric blocks composing the first and second resonators 21 and 22 and the evanescent waveguide 23 are defined the same as the corresponding surfaces of the band pass filter 1 explained earlier.

In the band pass filter 20 of this embodiment, the width of the evanescent waveguide 23 is set narrower than the widths of the first resonator 21 and the second resonator 22, whereas the thickness of the evanescent waveguide 23 are set to equal to thicknesses of the first resonator 21 and the second resonator 22. The top surfaces, bottom surfaces, and fourth side surfaces of the first resonator 21, second resonator 22, and evanescent waveguide 23 are thus coplanar. A dielectric unit of such a shape can be fabricated by forming a slit on a single dielectric unit at a portion corresponding to the third side surface of the evanescent waveguide 23.

As shown in FIGS. 13 and 14, metal plates 24, 25, and 26 are formed on the entire top surface, entire third side surface, and entire fourth side surface of the first resonator 21; and a metal plate 28 is formed on the bottom surface of the first resonator 21 except at a clearance portion 27. These metal plates 24, 25, 26, and 28 are short-circuited with one another. Similarly, metal plates 29, 30, and 31 are formed on the entire top surface, entire third side surface, and entire fourth side surface of the second resonator 22; and a metal plate 33 is formed on the bottom surface of the second resonator 22 except at a clearance portion 32. These metal plates 29, 30, 31, and 33 are short-circuited with one another. A metal plate 34 is formed on the entire bottom surface of the evanescent waveguide 23. These metal plates 24, 25, 26, 28, 29, 30, 31, 33, and 34 are thus short-circuited with one another and grounded.

As shown in FIG. 13, an exciting electrode 35 is formed on the second side surface of the first resonator 21 where the clearance portion 27 prevents the exciting electrode 35 from being in contact with the metal plate 28 formed on the bottom surface. Similarly, as shown in FIG. 14, an exciting electrode 36 is formed on the second side surface of the second resonator 22 where the clearance portion 32 prevents the exciting electrode 36 from being in contact with the metal plate 33 formed on the bottom surface. One of the exciting electrodes 35 and 36 is used as an input electrode, and the other is used as an output electrode.

Each of the first resonator 21 and the second resonator 22 having the above described structure acts as a half-wave ($\lambda/2$) dielectric resonator. The evanescent waveguide 23 having the above-described structure acts as an E-mode waveguide.

In the band pass filter 20, the coupling constant $k_{total}$ can be controlled based on the width of the evanescent waveguide 23.

Because, as described above, the band pass filter 20 according to this embodiment is constituted of the first resonator 21, the second resonator 22, and the evanescent waveguide 23 as a single unit, the overall size thereof can be reduced and fabrication of the band pass filter is simplified.

A further preferred embodiment of the present invention will now be explained.

Figure 15:
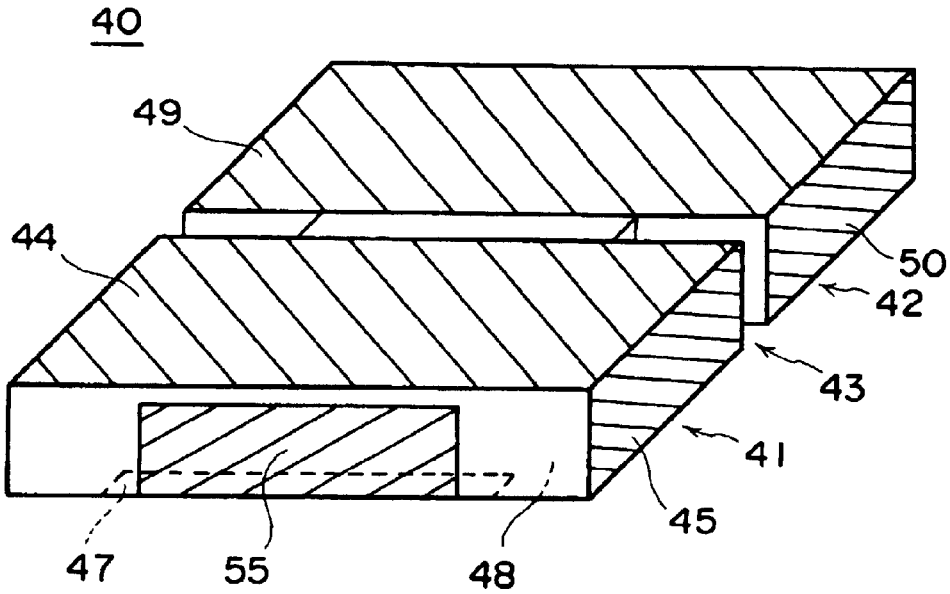
FIG. 15 is a schematic perspective view from one side showing a band pass filter 40 that is a further preferred embodiment of the present invention.
Figure 16:
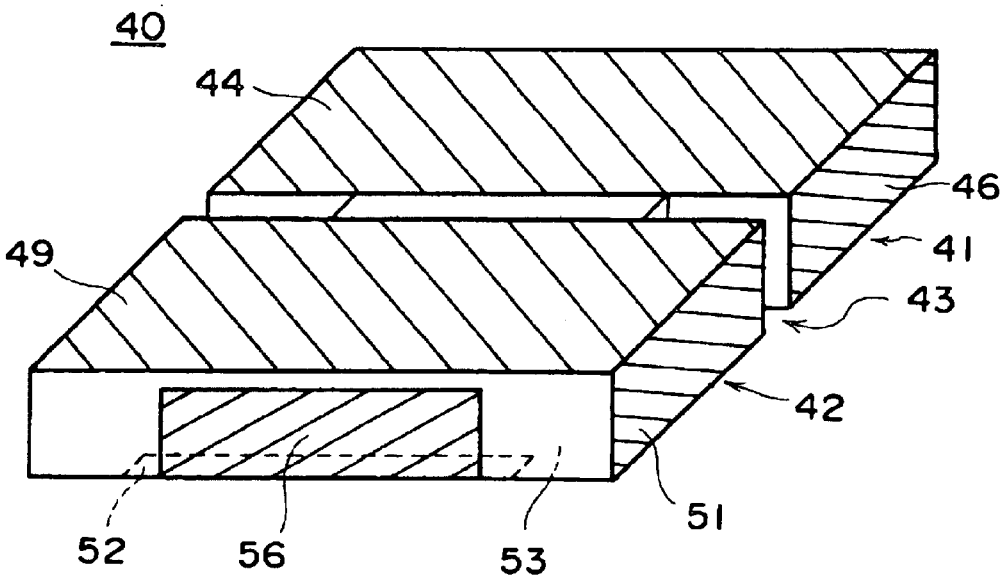
FIG. 16 is a schematic perspective view from the opposite side showing the band pass filter 40 of FIG. 15.

FIG. 15 is a schematic perspective view from one side showing a band pass filter 40 that is a further preferred embodiment of the present invention. FIG. 16 is a schematic perspective view from the opposite side showing the band pass filter 40 of FIG. 15.

As shown in FIGS. 15 and 16, the band pass filter 40 that is a further preferred embodiment of the present invention is constituted of a first resonator 41, a second resonator 42, and an evanescent waveguide 43 interposed between the first and second resonators 41 and 42. The top surfaces, bottom surfaces, first side surfaces, second side surfaces, third side surfaces, and fourth side surfaces of the dielectric blocks composing the first and second resonators 41 and 42 and the evanescent waveguide 43 are defined the same as the corresponding surfaces of the band pass filters 1 and 20 explained earlier.

In the band pass filter 40 of this embodiment, the width of the evanescent waveguide 43 is set narrower than the widths of the first resonator 41 and the second resonator 42, whereas the thickness of the evanescent waveguide 43 is set equal to thicknesses of the first resonator 41 and the second resonator 42. The top surfaces and bottom surfaces of the first resonator 41, second resonator 42, and evanescent waveguide 43 are thus coplanar. A dielectric unit of such a shape can be fabricated by forming slits in a single dielectric unit at portions corresponding to the third and fourth side surfaces of the evanescent waveguide 43.

As shown in FIGS. 15 and 16, metal plates 44, 45, and 46 are formed on the entire top surface, entire third side surface, and entire fourth side surface of the first resonator 41; and a metal plate 48 is formed on the bottom surface of the first resonator 41 except at a clearance portion 47. These metal plates 44, 45, 46, and 48 are short-circuited with one another. Similarly, metal plates 49, 50, and 51 are formed on the entire top surface, entire third side surface, and entire fourth side surface of the second resonator 42; and a metal plate 53 is formed on the bottom surface of the second resonator 42 except at a clearance portion 52. These metal plates 49, 50, 51, and 53 are short-circuited with one another. A metal plate (not shown) is formed on the entire bottom surface of the evanescent waveguide 43. These metal plates 44, 45, 46, 48, 49, 50, 51, and 53 and the metal plate formed on the bottom surface of the evanescent waveguide 43 are thus short-circuited with one another and grounded.

As shown in FIG. 15, an exciting electrode 55 is formed on the second side surface of the first resonator 41 where the clearance portion 47 prevents the exciting electrode 55 from being in contact with the metal plate 48 formed on the bottom surface. Similarly, as shown in FIG. 16, an exciting electrode 56 is formed on the second side surface of the second resonator 42 where the clearance portion 52 prevents the exciting electrode 56 from being in contact with the metal plate 53 formed on the bottom surface. One of the exciting electrodes 55 and 56 is used as an input electrode, and the other is used as an output electrode.

Each of the first resonator 41 and the second resonator 42 having the above described structure acts as a half-wave ($\lambda/2$) dielectric resonator. The evanescent waveguide 43 having the above-described structure acts as an E-mode waveguide.

In the band pass filter 40, as in the band pass filter 20 of the preceding embodiment, the coupling constant $k_{total}$ can be controlled based on the width of the evanescent waveguide 43.

Because, as described above, the band pass filter 40 according to this embodiment is constituted of the first resonator 41, second resonator 42, and evanescent waveguide 43 as a single unit, the overall size thereof can be miniaturized and fabrication of the band pass filter is simplified.

A further preferred embodiment of the present invention will now be explained.

Figure 17:
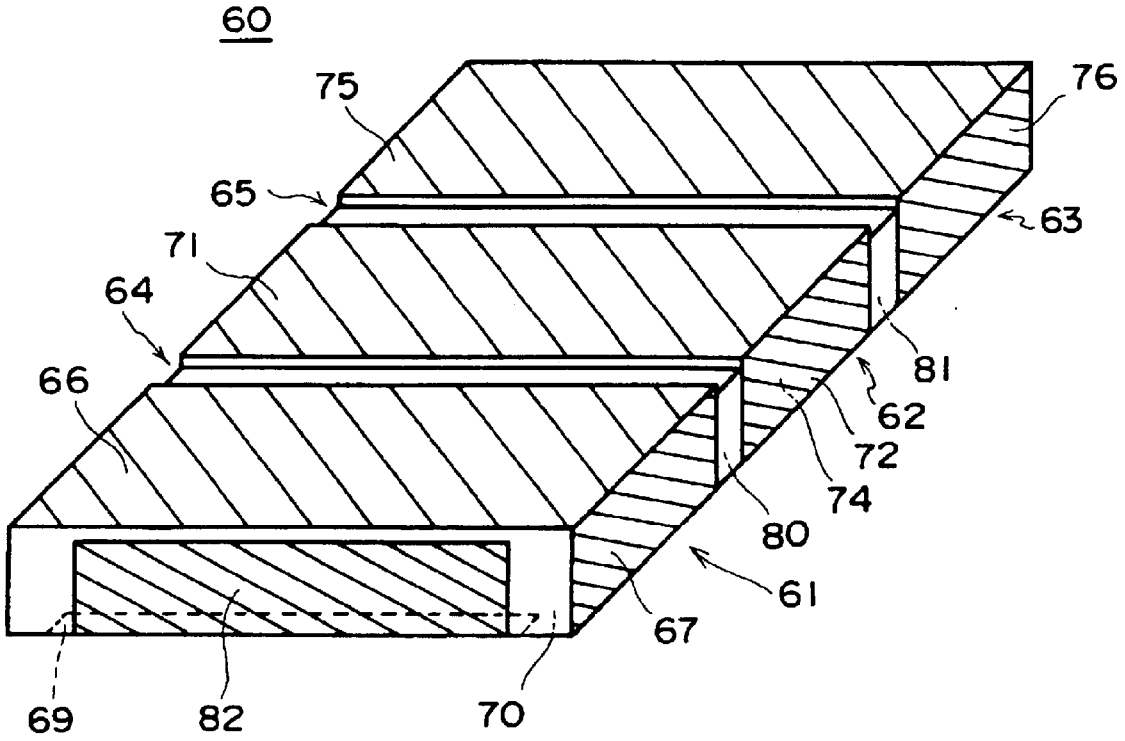
FIG. 17 is a schematic perspective view from one side showing a band pass filter 60 that is a further preferred embodiment of the present invention.
Figure 18:
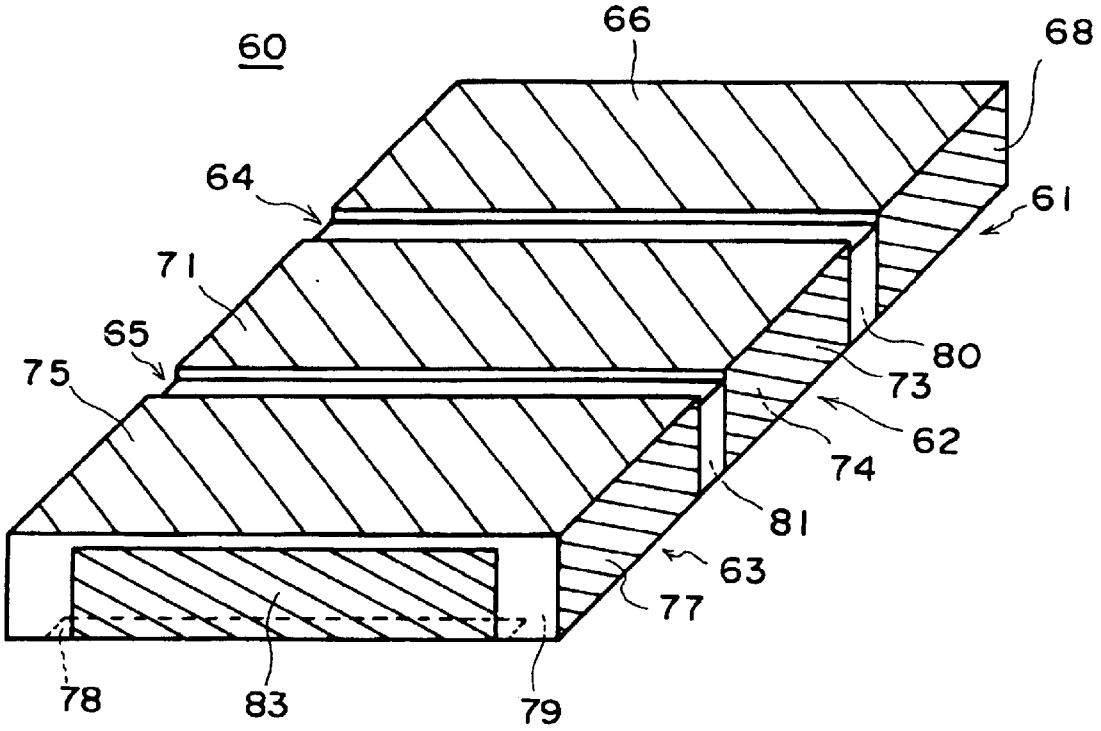
FIG. 18 is a schematic perspective view from the opposite side showing the band pass filter 60 of FIG. 17.

FIG. 17 is a schematic perspective view from one side showing a band pass filter 60 that is a further preferred embodiment of the present invention. FIG. 18 is a schematic perspective view from the opposite side showing the band pass filter 60 of FIG. 17.

As shown in FIGS. 17 and 18, the band pass filter 60 that is a further preferred embodiment of the present invention is constituted of a first resonator 61, a second resonator 62, a third resonator 63, a first evanescent waveguide 64 interposed between the first and second resonators 61 and 62, and a second evanescent waveguide 65 interposed between the second and third resonators 62 and 63. That is, the band pass filter 60 of this embodiment is a kind of 3-stage band pass filter.

The first resonator 61, second resonator 62, third resonator 63, first evanescent waveguide 64, and second evanescent waveguide 65 are combined such that their bottom surfaces are coplanar. It is worth noting that this does not mean that they are physically different components, but they constitute a single dielectric unit having slits in the top surface thereof at portions acting as the first evanescent waveguide 64 and second evanescent waveguide 65. That is, the band pass filter 60 of this preferred embodiment is also constituted of a single dielectric unit.

In this specification, the surfaces opposite to the associated bottom surfaces of the dielectric blocks composing the first resonator 61, second resonator 62, third resonator 63, first evanescent waveguide 64, and second evanescent waveguide 65 are each defined as a "top surface." Among the surfaces of the dielectric blocks composing the first and second resonators 61 and 62, each surface in contact with the first evanescent waveguide 64 is defined as a "first side surface." Among the surfaces of the dielectric blocks composing the first and second resonators 61 and 62, each surface opposite to the first side surface is defined as a "second side surface." The remaining surfaces of the dielectric blocks composing the first and second resonators 61 and 62 are defined as a "third side surface" and a "fourth side surface" with respect to each block. Among the surfaces of the dielectric block composing the third resonator 63, the surface in contact with the second evanescent waveguide 65 is defined as a "first side surface." Among the surfaces of the dielectric block composing the third resonator 63, the surface opposite to the first side surface is defined as a "second side surface." The remaining surfaces of the dielectric block composing the third resonator 63 are defined as a "third side surface" and a "fourth side surface." Among the surfaces of the dielectric block composing the first evanescent waveguide 64, the surface in contact with the first side surface of the first resonator 61 is defined as a "first side surface." Among the surfaces of the dielectric block composing the first evanescent waveguide 64, the surface in contact with the first side surface of the second resonator 62 is defined as a "second side surface." The remaining surfaces of the dielectric block composing the first evanescent waveguide 64 are defined as a "third side surface" and a "fourth side surface." Among the surfaces of the dielectric block composing the second evanescent waveguide 65, the surface in contact with the first side surface of the third resonator 63 is defined as a "first side surface." Among the surfaces of the dielectric block composing the second evanescent waveguide 65, the surface in contact with the second side surface of the second resonator 62 is defined as a "second side surface." The remaining surfaces of the dielectric block composing the second evanescent waveguide 65 are defined as a "third side surface" and a "fourth side surface."

The third side surfaces of the first resonator 61, second resonator 62, third resonator 63, first evanescent waveguide 64, and second evanescent waveguide 65 are coplanar, and the fourth side surfaces thereof are also coplanar.

As shown in FIGS. 17 and 18, metal plates 66, 67, and 68 are formed on the entire top surface, entire third side surface, and entire fourth side surface of the first resonator 61; and a metal plate 70 is formed on the bottom surface of the first resonator 61 except at a clearance portion 69. These metal plates 66, 67, 68, and 70 are short-circuited with one another. Metal plates 71, 72, 73, and 74 are formed on the entire top surface, entire third side surface, entire fourth side surface, and entire bottom surface of the second resonator 62. These metal plates 71, 72, 73, and 74 are short-circuited with one another. Metal plates 75, 76, and 77 are formed on the entire top surface, entire third side surface, and entire fourth side surface of the third resonator 63; and a metal plate 79 is formed on the bottom surface of the third resonator 63 except at a clearance portion 78. These metal plates 75, 76, 77, and 79 are short-circuited with one another. Further, metal plates 80 and 81 are formed on the entire bottom surfaces of the first and second evanescent waveguides 64 and 65, respectively. These metal plates 66, 67, 68, 70, 71, 72, 73, 74, 75, 76, 77, 79, 80, and 81 are thus short-circuited with one another and grounded.

As shown in FIG. 17, an exciting electrode 82 is formed on the second side surface of the first resonator 61 where the clearance portion 69 prevents the exciting electrode 82 from being in contact with the metal plate 70 formed on the bottom surface. Similarly, as shown in FIG. 18, an exciting electrode 83 is formed on the second side surface of the third resonator 63 where the clearance portion 78 prevents the exciting electrode 83 from being in contact with the metal plate 79 formed on the bottom surface. One of the exciting electrodes 82 and 83 is used as an input electrode, and the other is used as an output electrode.

Each of the first to third resonators 61 to 63 having the above-described structure acts as a half-wave ($\lambda/2$) dielectric resonator. Each of the first and second evanescent waveguides 64 and 65 having the above-described structure acts as an E-mode waveguide.

In the band pass filter 60, frequency characteristics having sharp edges compared with above described band pass filters 1, 20, and 40 can be obtained by setting the coupling constant $k1_{total}$ between the first resonator 61 and the second resonator 62 and the coupling constant $k2_{total}$ between the second resonator 62 and the third resonator 63 to substantially the same value. The coupling constant $k1_{total}$ between the first resonator 61 and the second resonator 62 can be controlled based on the thickness of the first evanescent waveguide 64. The coupling constant $k2_{total}$ between the second resonator 62 and the third resonator 63 can be controlled based on the thickness of the second evanescent waveguide 65. In a three state band pass filter, $|k1_{total}|=|k2_{total}|$.

Because, as described above, the band pass filter 60 according to this embodiment is constituted of the first resonator 61, second resonator 62, third resonator 63, first evanescent waveguide 64, and second evanescent waveguide 65 as a single unit, the overall size thereof can be reduced and fabrication of the band pass filter is simplified.

A further preferred embodiment of the present invention will now be explained.

Figure 19:
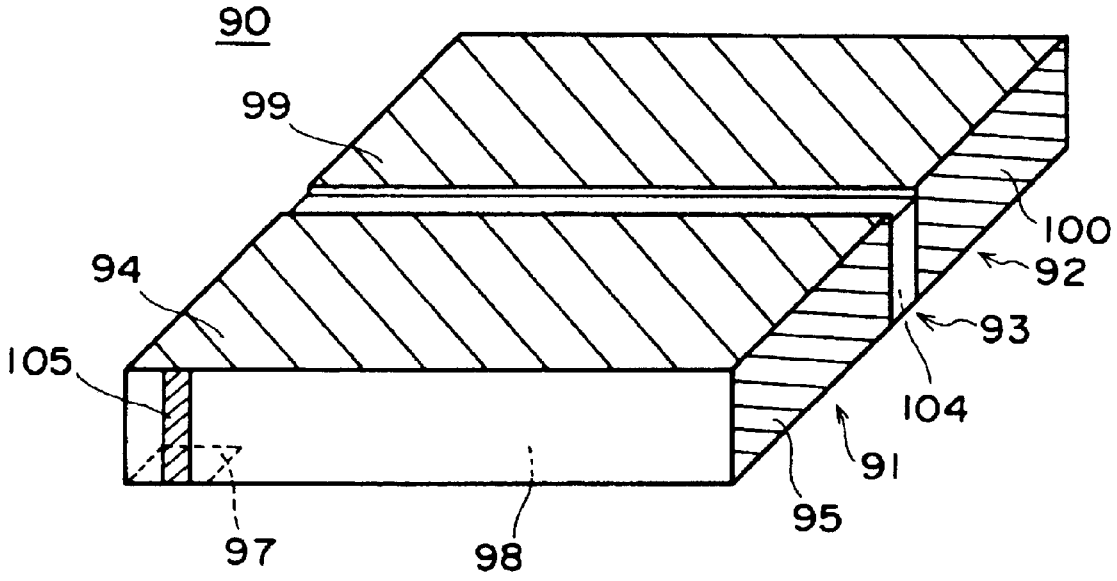
FIG. 19 is a schematic perspective view from one side showing a band pass filter 90 that is a further preferred embodiment of the present invention.
Figure 20:
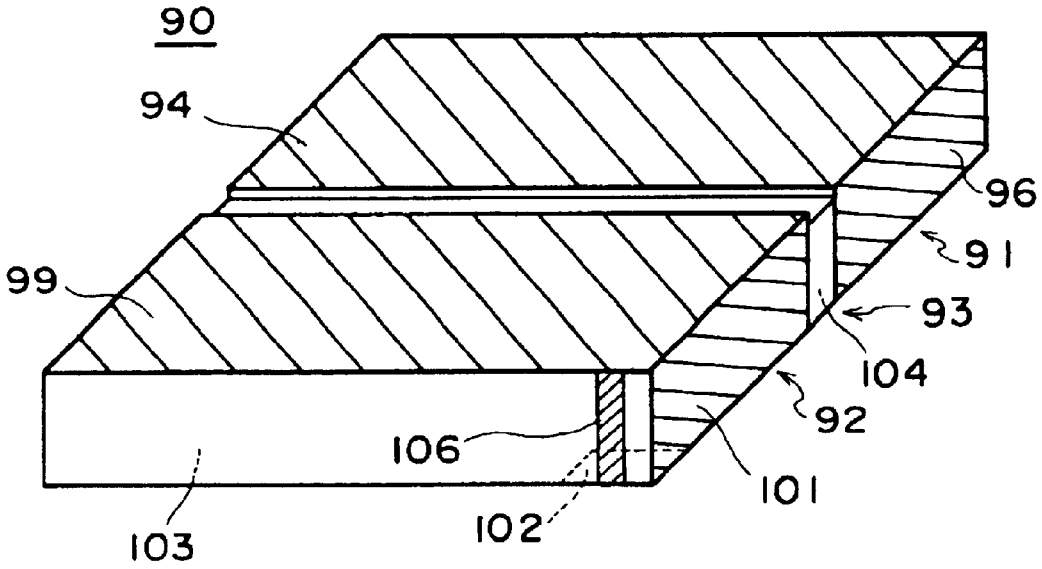
FIG. 20 is a schematic perspective view from the opposite side showing the band pass filter 90 of FIG. 19.

FIG. 19 is a schematic perspective view from one side showing a band pass filter 90 that is a further preferred embodiment of the present invention. FIG. 20 is a schematic perspective view from the opposite side showing the band pass filter 90 of FIG. 19.

As shown in FIGS. 19 and 20, the band pass filter 90 that is a further preferred embodiment of the present invention is constituted of a first resonator 91, a second resonator 92, and an evanescent waveguide 93 interposed between the first and second resonators 91 and 92. The top surfaces, bottom surfaces, first side surfaces, second side surfaces, third side surfaces, and fourth side surfaces of the dielectric blocks composing the first and second resonators 91 and 92 and the evanescent waveguide 93 are defined the same as the corresponding surfaces of the band pass filters 1, 20, and 40 explained earlier.

In the band pass filter 90 of this embodiment, like in the band pass filter 1 described above, the thickness of the evanescent waveguide 93 is set smaller than that of the first resonator 91 and the second resonator 92, whereas the width of the evanescent waveguide 93 is set equal to that of the first resonator 91 and the second resonator 92. The bottom surfaces, third side surfaces, and fourth side surfaces of the first resonator 91, second resonator 92, and evanescent waveguide 93 are thus coplanar. A dielectric unit of such a shape can be fabricated by forming a slit in a single dielectric unit at a portion corresponding to the top surface of the evanescent waveguide 93.

As shown in FIGS. 19 and 20, metal plates 94, 95, and 96 are formed on the entire top surface, entire third side surface, and entire fourth side surface of the first resonator 91; and a metal plate 98 is formed on the bottom surface of the first resonator 91 except at a clearance portion 97. These metal plates 94, 95, 96, and 98 are short-circuited with one another. Similarly, metal plates 99, 100, and 101 are formed on the entire top surface, entire third side surface, and entire fourth side surface of the second resonator 92; and a metal plate 103 is formed on the bottom surface of the second resonator 92 except at a clearance portion 102. These metal plates 99, 100, 101, and 103 are short-circuited with one another. A metal plate 104 is formed on the entire bottom surface of the evanescent waveguide 93. These metal plates 94, 95, 96, 98, 99, 100, 101, 103, and 104 are thus short-circuited with one another and grounded.

As shown in FIG. 19, an exciting electrode 105 is formed on the second side surface of the first resonator 91. The exciting electrode 105 is in contact with the metal plate 94 formed on the top surface whereas the clearance portion 97 prevents the exciting electrode 105 from being in contact with the metal plate 98 formed on the bottom surface. Similarly, as shown in FIG. 20, an exciting electrode 106 is formed on the second side surface of the second resonator 92. The exciting electrode 106 is in contact with the metal plate 99 formed on the top surface whereas the clearance portion 102 prevents the exciting electrode 105 from being in contact with the metal plate 103 formed on the bottom surface. One of the exciting electrodes 105 and 106 is used as an input electrode, and the other is used as an output electrode. The exciting electrodes 105 and 106 are inductive exciting electrodes whereas the exciting electrodes used in the above described embodiments are capacitive exciting electrodes.

Each of the first resonator 91 and the second resonator 92 having the above described structure acts as a half-wave ($\lambda/2$) dielectric resonator. The evanescent waveguide 93 having the above-described structure acts as an E-mode waveguide.

In the band pass filter 90, like in the band pass filter 1, the coupling constant $K_{total}$ can be controlled based on the thickness of the evanescent waveguide 93.

Because, as described above, the band pass filter 90 according to this embodiment is constituted of the first resonator 91, second resonator 92, and evanescent waveguide 93 as a single unit, the overall size thereof can be reduced and fabrication of the band pass filter is simplified.

The present invention has thus been shown and described with reference to specific embodiments. However, it should be noted that the present invention is in no way limited to the details of the described arrangements but changes and modifications may be made without departing from the scope of the appended claims.

For example, in the above described embodiments, the dielectric blocks for the resonators and the evanescent waveguide are made of dielectric material whose dielectric constant $\in r$ is 37. However, a material having a different dielectric constant can be used according to purpose.

Further, the dimensions of the resonators and the evanescent waveguide specified in the above described embodiments are only examples. Resonators and an evanescent waveguide having different dimensions can be used according to purpose.

Furthermore, in the band pass filters 1, 60, and 90, the coupling constant is controlled based on the thickness of the evanescent waveguide, and in the band pass filters 20 and 40, the coupling constant is controlled based on the width of the evanescent waveguide. However, the coupling constant can be controlled based on both thickness and width of the evanescent waveguide.

Further, the band pass filter 60 is configured to have three stages by using three resonators, but a band pass filter can also be configured to have four or more stages by using four or more resonators.

Because, as described above, the band pass filter according to the present invention is constituted of the resonators and the evanescent waveguide interposed between the resonators as a single unit, an air gap does not have to be formed by mounting components on a printed circuit board. Therefore, the overall size of the band pass filter can be miniaturized and fabrication of the band pass filter is simplified. Further, in the band pass filter according to the present invention, because the half-wave ($\lambda/2$) dielectric resonators are used, the radiation loss occurring at the open ends is very small.

Therefore, the present invention provides a band pass filter that can be preferably utilized in communication terminals such as mobile phones and the like, LANs (Local Area Networks), ITS (Intelligent Transport Systems) and various communication systems, where filtering is needed.

What is claimed is:

1. A band pass filter comprising:

a first half-wave (λ/2) TEM mode resonator constituted by a first dielectric block having a first open end at the first side surface, a second open end at the second side surface opposite to the first open end, an input terminal formed on the second side surface, and metal plates formed on top and bottom surfaces which are opposite to each other and on third and forth side surfaces which are opposite to each other, a second half-wave (λ/2) TEM mode resonator constituted by a second dielectric block having a first open end at the first side surface, a second open end at the second side surface opposite to the first open end, an output terminal formed in the second side surface, and metal plates formed on top and bottom surfaces which are opposite to each other and on third and forth side surfaces which are opposite to each other, an evanescent E-mode waveguide interposed between the first open end of the first half-wave (λ/2) TEM mode resonator and the first open end of the second half-wave (λ/2) TEM mode resonator, and wherein the first half-wave (λ/2) TEM mode resonator, the second half-wave (λ/2) TEM mode resonator and an evanescent waveguide are a single unit.

2. The band pass filter as claimed in claim 1, wherein the passing band low frequency is greater than 5 GHz.

3. The band pass filter as claimed in claim 2, wherein the evanescent E-mode waveguide is constituted by a third dielectric block which has a first side surface in contact with the first side surface of the first resonator and a second side surface in contact with the first side surface of the second resonator, top and bottom surfaces which are opposite to each other, and third and fourth surfaces which are opposite to each other, a metal plate being formed on the bottom surface, and wherein the bottom surfaces of the first, second and third dielectric blocks are coplanar.

4. The baud pass filter as claimed in claim 3, wherein the top surfaces of the first, second and third dielectric blocks are coplanar.

5. The band pass filter as claimed in claim 3, wherein members of at least one pair of surfaces among a first pair consisting of the top surfaces of the first and third dielectric blocks, a second pair consisting of the third surfaces of the first and third dielectric blocks, and a third pair consisting of the fourth surfaces of the first and third dielectric blocks, fall in different planes.

* * * * *

UNITED STATES PATENT AND TRADEMARK OFFICE

CERTIFICATE OF CORRECTION

PATENT NO. : 6,714,103 B2
APPLICATION NO. : 10/005724
DATED : March 30, 2004
INVENTOR(S) : Arun Chandra Kundu It is certified that error appears in the above-identified patent and that said Letters Patent is hereby corrected as shown below:

Column 6
Line 24, after the word "resonator" and before the word "The" insert --¶--.

Column 16
Line 13, Claim 4, change the word "baud" to --band--.

Signed and Sealed this

First Day of January, 2008

JON W. DUDAS
*Director of the United States Patent and Trademark Office*